United States Patent [19]

Whitford

[11] 4,188,958

[45] Feb. 19, 1980

[54] SMOKING PIPE

[76] Inventor: Leon Whitford, 1015 S. 5th St., Greenville, Ill. 62246

[21] Appl. No.: 957,526

[22] Filed: Nov. 3, 1978

[51] Int. Cl.[2] ..... A24F 1/08

[52] U.S. Cl. ..... 131/194; 131/202; 131/261 R; 131/263

[58] Field of Search ..... 131/194, 216, 173, 200, 131/201, 202, 215, 215 B, 223, 261 R, 263

[56] References Cited

U.S. PATENT DOCUMENTS

| | | | |
|---|---|---|---|
| 722,543 | 3/1903 | Thornton | 131/194 |
| 1,025,639 | 5/1912 | Morris | 131/194 |
| 1,397,946 | 11/1921 | Dossin | 131/216 X |

*Primary Examiner*—Stephen C. Pellegrino

*Attorney, Agent, or Firm*—Gravely, Lieder & Woodruff

[57] ABSTRACT

A smoking pipe having a means for removing tars, and other particles from the smoke by the principle of occlusion by water vapor. The water vapor is produced by heat released from burning tobacco. The pipe also has a transparent bypass located on the stem to encase a filter for tars and other particles. The transparent character will allow observers to view the filtration process.

5 Claims, 3 Drawing Figures

SMOKING PIPE

BACKGROUND OF THE INVENTION

This invention involves smoking pipes, and, in particular, a smoking pipe with multiple means for removing tars, and other undesirable particles from the smoke.

I am aware of earlier patents to Anderson U.S. Pat. No. 2,564,799, Swan U.S. Pat. No. 2,319,756, Williamson U.S. Pat. No. 2,655,158, Dossin U.S. Pat. No. 1,397,946 and Herr U.S. Pat. No. 2,206,188 all of which failed to achieve commercial success for a number of reasons. None of the foregoing listed patents functions in a fashion similar to my invention and none has all of the advantages of my pipe.

The primary object of this invention is to provide a means for removing tar and other unwanted particles from pipe smoke.

Another object is to provide a means for filtering unwanted particles from pipe smoke which allows the user to observe the filtration process.

Various other objects and advantages of the invention will hereinafter become more fully apparent from the following description of the drawings, illustrating a preferred embodiment thereof, and wherein like numbers refer to like parts wherever they occur.

DETAILED DESCRIPTION

Figure 1:
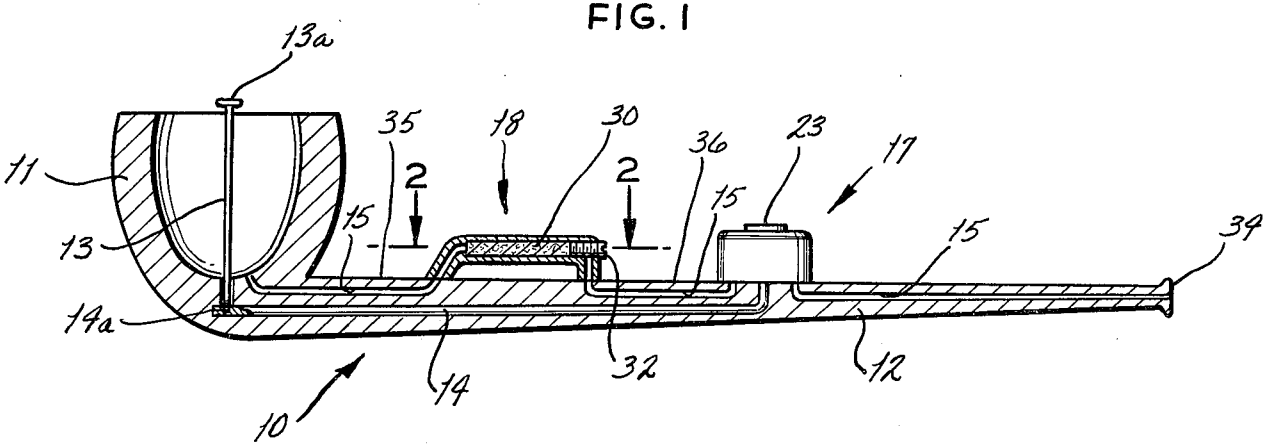
FIG. 1 is a vertical sectional view of a preferred embodiment of the pipe.

FIG. 1 shows a pipe 10 having a bowl 11 and a stem 12. A heating pin 13 is positioned within the bowl 11 at its center. The pin 13 projects upwardly from the base of the bowl 11 and is made of a heat conducting material, preferably metal. The heating pin 13 transfers heat from the combustion materials in the bowl 11 to a heating rod 14, one end of which is in contact with the lower end of the heating pin 13 within the bottom wall of the bowl 11. The lower end of the heating pin 13 is preferably threaded and screwed into a similarly threaded opening 14*a* on the end of heating rod 14. The pin 13 has a head 13*a* to assist in threading it into the rod 14.

The heating rod 14 may have insulation positioned around it to prevent dissipation of heat and to keep the stem 12 from becoming too hot to the touch. Preferably the stem 12 itself is of an opaque insulating plastic construction. The heating rod 14 should be a readily conducting metal such as stainless steel, etc. The heating rod 14 runs partly through the pipe stem 12 and terminates at an upturned portion 16 which extends into a water vapor filter system 17 (FIG. 3).

A smoke passage 15 runs from the bottom of the bowl 11 through the stem 12 into a filter by-pass system 18 (FIG. 2), back into the stem 12, and then exits into a first compartment 20 of the water vapor filter system 17. The compartment 20 is hereinafter referred to as the vapor chamber. The smoke passage 15 resumes by exiting from the vapor chamber 20 and passes through the remainder of the stem 12 to a bit 34.

Figure 3:
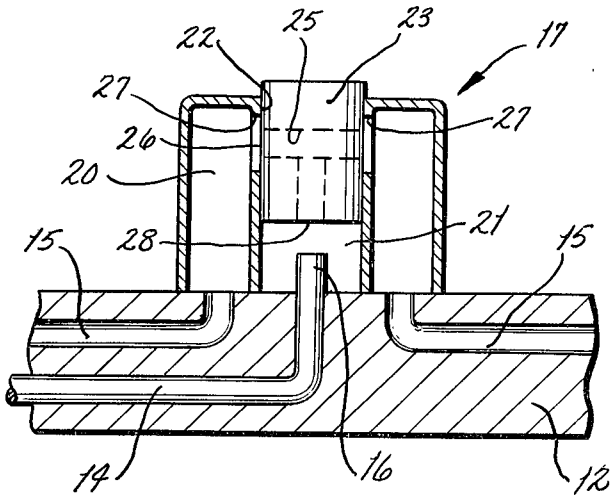
FIG. 3 is an enlarged sectional view of the pipe showing the vapor chamber, water container, and plug area.

The vapor chamber 20 is positioned on the stem 12 as is shown in FIG. 3 in detail. In the preferred embodiment, it is cylindrical. Within the vapor chamber 20 is disposed a smaller cylindrical receptacle 21 having a tap opening 22. The receptacle 21 hereinafter will be referred to as the water container 21. The water container 21 is in contact with the heating rod 14 at point 16. A plug 23 may be inserted into the tap opening 22 to close the tap of the water container 21. The plug 23 seals the vapor chamber 20 and the water container 21 from the environment. To fill the water container 21, the plug 23 is removed, and water is poured into the water container.

The plug 23 has a "T" shaped passage 25 with side aperture 26 opening into the vapor chamber 20 through slots 27 and an aperture 28 opening into the water chamber 21 so that the water vapor can flow through the plug 23 into the vapor chamber 20.

The water is vaporized by heat from the heating rod 14. The source of heat for the heating rod 14 is the heat of combustion of the tobacco from the bowl 11. The heat of combustion is conducted from the heating pin 13 to the heating rod 14, and is transferred to the water in the water container 21. When the water is vaporized it will flow up into aperture 28 through vapor passage 25, through side apertures 26, and through the slots 27 into the smoke chamber 20. The plug may have more apertures and more passageways, but it is preferable to have fewer in order to preserve the integrity of the plug.

As the water vaporizes, minute water droplets occupy some of the space in the vapor chamber 20. The smoke from the smoke passage flows into the vapor chamber 20. The droplets in the vapor chamber engage larger bodies in the smoke stream, such as tars and other large particles, and cause them to be removed from the smoke, thus giving a cleaner smoke. The smoke in the vapor chamber 20 exits through the smoke passage on the user side of the vapor chamber 20 by means of suction.

In the preferred embodiment of this invention, a bypass 18 is provided. This bypass 18 is disposed on the pipe stem 12 and the smoke passage 15 enters and exits the bypass 18.

The bypass 18 is hollow and will allow the tobacco smoke to pass through it.

The bypass 18 is preferably constructed of a transparent material. This is desirable so that the smoker or anyone else can observe the smoke traveling through the bypass. Within the bypass 18 is placed a material 30 capable of filtering tars, nicotine, and other particles from the tobacco smoke. Suitable filtering materials include activated carbon or activated charcoal.

Figure 2:
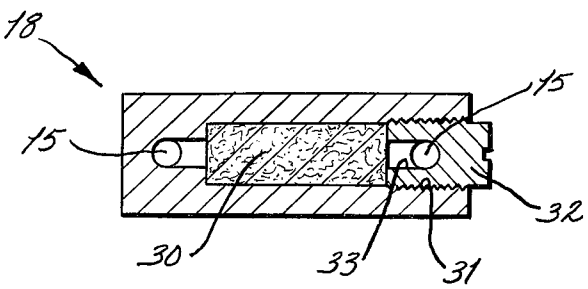
FIG. 2 is an enlarged sectional view of the pipe taken along line 2—2 of FIG. 1.

FIG. 2 shows the bypass 18 in more detail. The bypass 18 has an opening 31 through which the filter 30 is inserted. The opening 31 is sealed by means of a threaded plug 32. To replace the filter 30, the plug 32 is removed, the spent filter 30 is removed, a new filter 30 is sealed with the plug 32. The plug 32 is provided with a slot 33 on its inner end to align with the passageway 15 to permit smoke to pass through the filters 30 and back into the smoke passage 15 in the stem 12.

The stem 12 has a finger hold 35 between the bowl 11 and the bypass 18 and a finger hold 36 between the bypass 18 and the vapor system 17.

What is claimed:

1. Smoking pipe comprising:

A. a bowl;

B. a stem connected to said bowl;

C. a smoke passageway beginning at the base of said bowl and running through said stem to a first compartment means, said smoke passageway exiting said first compartment means and running through the stem to a bit;

D. an open second compartment means situated within said first compartment means for containing fluid;

E. a removable plug to seal said second compartment means, said plug having at least one passageway running from said second compartment means to said first compartment means so that fluid from said second compartment means can travel to said first compartment means;

F. a heating pin located within said bowl, said heating pin connected to a heating rod, said heating rod running through said stem and projecting into said second compartment means.

2. The pipe of claim 1 wherein heat from the pipe bowl heats said heating pin, which in turn transfers heat to said heating rod, and heat from said heating rod vaporizes fluid in said second compartment means.

3. The pipe of claim 2 wherein the fluid is water.

4. The pipe of claim 1 wherein a bypass means is included on said stem, said smoke passageway running through said bypass means, said bypass having a filtering material disposed therein.

5. The pipe of claim 4 wherein the bypass is made of transparent material to allow visualization of the filtering activity.

* * * * *